US007909648B2

(12) United States Patent
Tai

(10) Patent No.: US 7,909,648 B2
(45) Date of Patent: Mar. 22, 2011

(54) ELECTRIC CONNECTOR HAVING GROUND CONTACTS FORMED FROM A GROUNDING SHIELD

(75) Inventor: Kenny Tai, Taoyuan (TW)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/312,532

(22) PCT Filed: Nov. 23, 2007

(86) PCT No.: PCT/IB2007/055393

§ 371 (c)(1),
(2), (4) Date: May 13, 2009

(87) PCT Pub. No.: WO2008/062390

PCT Pub. Date: May 29, 2008

(65) Prior Publication Data

US 2010/0068931 A1 Mar. 18, 2010

(30) Foreign Application Priority Data

Nov. 24, 2006 (TW) ..... 95143680 A

(51) Int. Cl.
*H01R 13/648* (2006.01)

(52) U.S. Cl. ..... 439/607.32

(58) Field of Classification Search ..... 439/607.31, 439/607.32, 607.33; 438/607.4
See application file for complete search history.

(56) References Cited

U.S. PATENT DOCUMENTS

| | | | | |
|---|---|---|---|---|
| 5,478,260 | A * | 12/1995 | Kaufman et al. | 439/607.31 |
| 5,964,597 | A * | 10/1999 | Hirata et al. | 439/108 |
| 6,027,365 | A * | 2/2000 | Kaufman | 439/489 |
| 6,116,925 | A * | 9/2000 | Tung | 439/101 |
| 6,203,353 | B1 | 3/2001 | Huang et al. | 439/352 |
| 6,682,368 | B2 * | 1/2004 | Murr et al. | 439/607.28 |
| 6,821,158 | B2 * | 11/2004 | Iida et al. | 439/660 |
| 7,134,912 | B2 * | 11/2006 | Kamata et al. | 439/607.31 |
| 2003/0176111 | A1 | 9/2003 | Iida et al. | 439/660 |
| 2005/0260871 | A1 | 11/2005 | Kamata et al. | 439/79 |

FOREIGN PATENT DOCUMENTS

| | | |
|---|---|---|
| EP | 1 635 429 A1 | 3/2006 |
| TW | 559356 | 10/1991 |
| TW | M283398 | 4/1994 |

OTHER PUBLICATIONS

CN English Language Abstract, Electric Connector , Oct. 22, 2003, Foxconn Kunshan Comp Connector (CN), CN-2582212.
CN English Language Abstract, Connectors with Improved Contact Structure, Jan. 1, 2007, Dachang Electronics Science & (CN), CN-2862422.

* cited by examiner

*Primary Examiner* — Neil Abrams
(74) *Attorney, Agent, or Firm* — Harrington & Smith

(57) ABSTRACT

An electric connector has a housing, signal and ground contacts disposed in the housing and a metal shell surrounding the housing. The metal shell has a support segment covering a top surface of the housing and with a first edge positioned adjacent to a back surface of the housing, and a second edge positioned adjacent to a front surface of the housing. The ground contacts are formed integral with and extend forwardly from the second edge of the support segment by a one-step stamping process.

10 Claims, 8 Drawing Sheets

ELECTRIC CONNECTOR HAVING GROUND CONTACTS FORMED FROM A GROUNDING SHIELD

This application claims priority from Taiwan patent application number 095143680, filed on 24 Nov. 2006, entitled "ELECTRIC CONNECTOR", which is hereby incorporated by reference.

TECHNICAL FIELD

The present invention relates to an electric connector, and more particularly to an electric connector having a metal shell serving as a grounding shield.

BACKGROUND

Electric connectors are used to establish electrical connections between electronic devices and systems. With the increasing requirements on system integration and minimization, electric connectors are arranged in the electronic systems more and more close to each other, and transmitting electronic signals with higher signal transmission speed. As a result, the electromagnetic interference between the neighboring electric connectors and the external electromagnetic radiation are greatly increased, which may adversely influence the signal transmitting quality.

To reduce or eliminate the electromagnetic interference, a metal shell may be arranged outside the electric connector, which can serve as grounding shield for the connector. To ground a mating counterpart connector, grounding contacts are also provided on the metal shell and for connecting to the counterpart connector.

Persons skilled in the art would appreciate that the positional coplanarity of the signal contacts and the grounding contacts in the electric connector will affect the ultimate performance. However, the manufacturing of known electric connectors of this type has a problem in that, the coplanarity of the signal contacts and grounding contacts are difficult to be ensured. The unsatisfactory coplanarity of the contacts may cause a non-uniform contact pressure between each contact and the counterpart connector, and even causes poor or fail contacts.

It is therefore desirable to provide an electric connector that has a satisfactory performance, is easy to manufacture and having contact terminals with ensured coplanarity.

SUMMARY OF THE INVENTION

Accordingly, an objective of the present invention is to provide an electric connector, which is easy to manufacture and has parts with high accuracy.

Another objective of the present invention is to provide an electric connector, which has a metal shell that is easy to manufacture and grounding contacts of preferred coplanarity.

A further objective of the present invention is to provide an electric connector, which has a low cost and a fast manufacturing process.

As embodied and broadly described herein, the present invention provides an electric connector, which comprises a housing, a plurality of signal contacts, and a metal shell. The housing comprises a body having a first wall, a second wall opposite to the first wall, and a space formed between the first wall and the second wall for receiving a counterpart connector, a plurality of upper grooves formed on a first inner surface of the first wall, a plurality of lower grooves formed on a second inner surface of the second wall, and a recess formed on an outer rear surface of the housing in which the recess is communicating with the space through the upper grooves. The signal contacts are disposed in the lower grooves of the housing. The metal shell comprises a frame portion encompassing the housing and an inwardly deformed portion. The inwardly deformed portion integrally connects the frame portion by means of a bent portion and is recessed downwardly with respect to the frame portion. The inwardly deformed portion comprises a straight portion embedded in the recess of the housing and a plurality of grounding contacts extending from the straight portion and inserting into the upper grooves.

In one embodiment, each of the grounding contacts of the metal shell comprises a contact portion for contacting the counterpart connector to ground, and a spring portion coupled to the contact portion to elastically move the contact portion.

In another embodiment, the metal shell further comprises at least one folding portion extending from the frame portion and folded inwardly into the frame portion to be engaged with at least one side wall of the housing. The housing further comprises a plurality of holes, and the frame portion of the metal shell further comprises a plurality of first protruding portions for inserting into the holes to fax the metal shell and the housing together.

DETAILED DESCRIPTION

Figure 1:
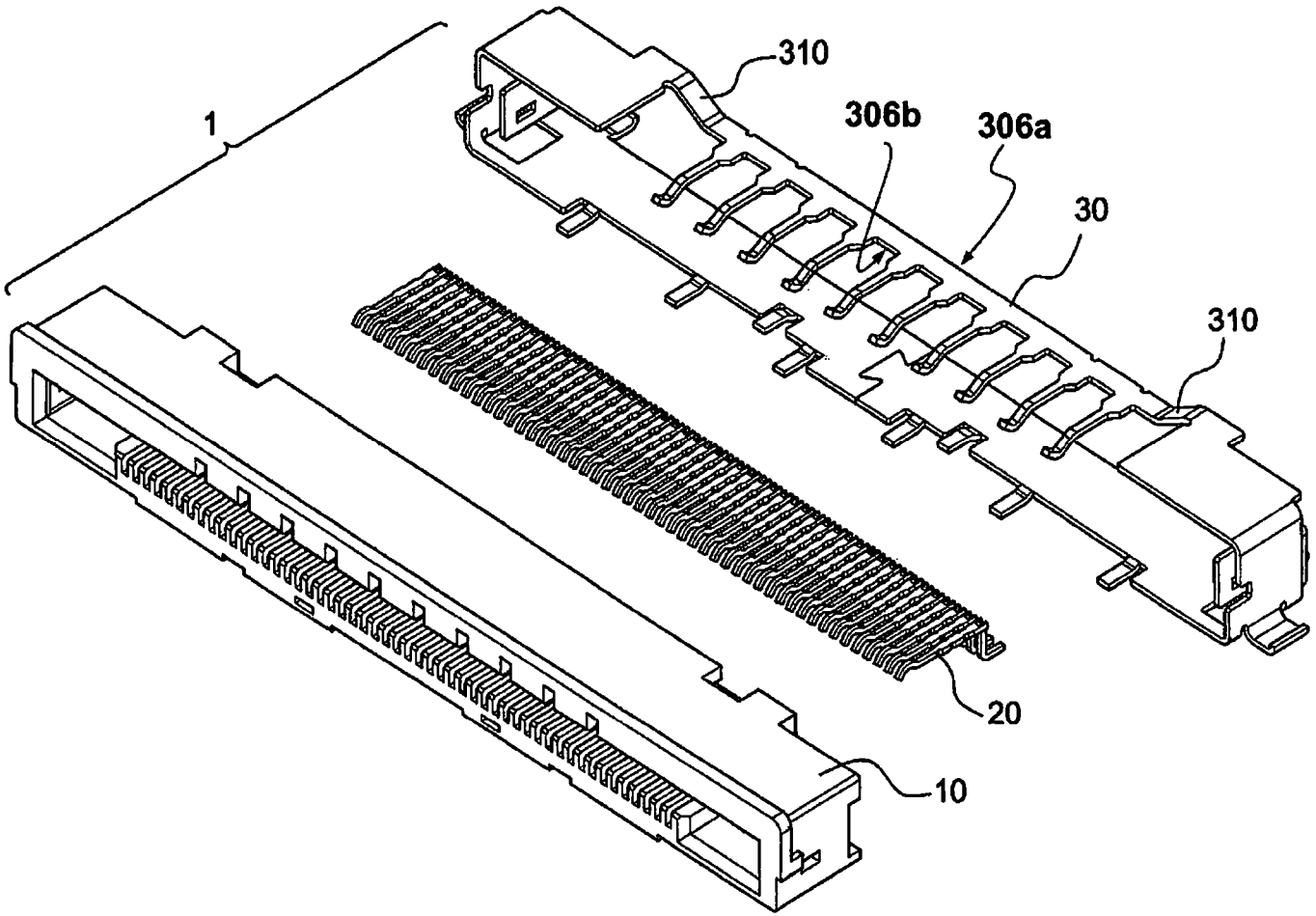
FIG. 1 is an exploded perspective view of an electric connector according to one embodiment of the present invention.
Figure 2:
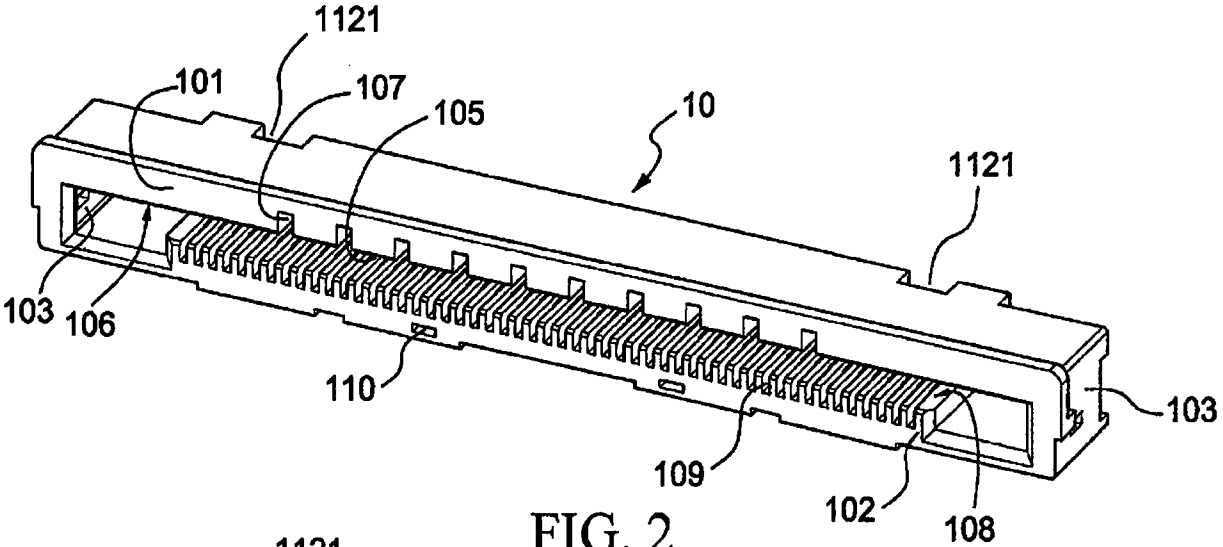
FIG. 2 is a perspective front side view of the housing of a connector shown in FIG. 1.

Referring to FIG. 1 and FIG. 2, an electric connector 1 according to one embodiment of the present invention includes a housing 10, a plurality of signal contacts 20 to be disposed in housing 10, and a metal shell 30 which provides a grounding shield for connector 1. Housing 10 has a first wall 101, a second wall 102 opposite to first wall 101, two side walls 103, and a rear wall 104. A space or slot 105 is formed between the first wall 101 and the second wall 102 for receiving a counterpart connector (not shown).

First wall 101 has a first inner surface 106 with a plurality of upper grooves 107 formed thereon. Second wall 102 has a second inner surface 108 with a plurality of lower grooves 109 formed thereon. Housing 10 further comprises a plurality of holes 110.

Figure 3:
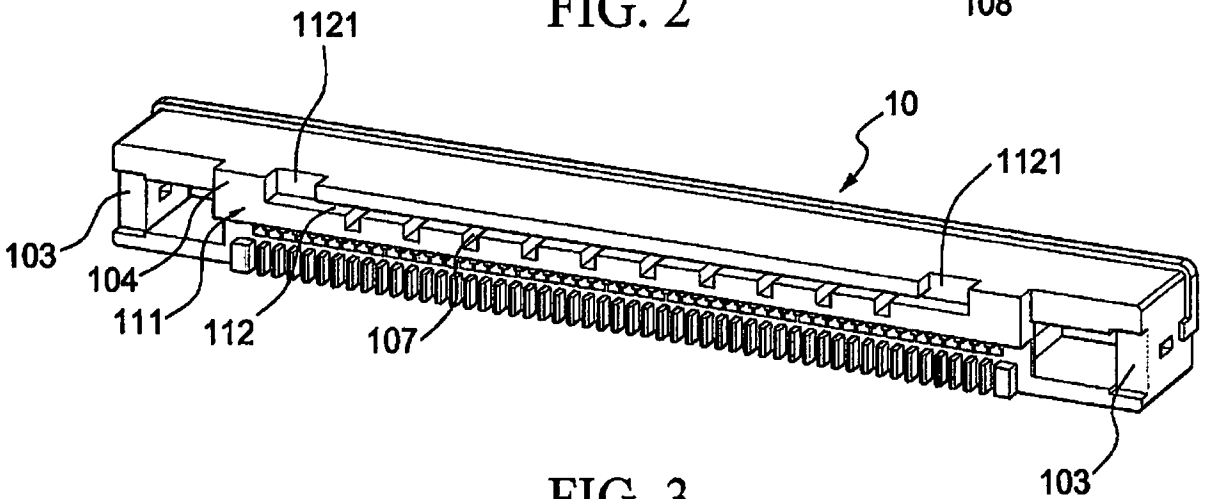
FIG. 3 is a perspective rear side view of FIG. 2.

As shown in FIG. 3, an elongated recess 112 is formed on an outer rear surface 111 of the rear wall 104 of housing 10 in which the recess 112 is communicating with space 105 through upper grooves 107. Two ends of recess 112 are respectively formed with a notch 1121 opening to upper surface of housing 10.

Figure 4A:
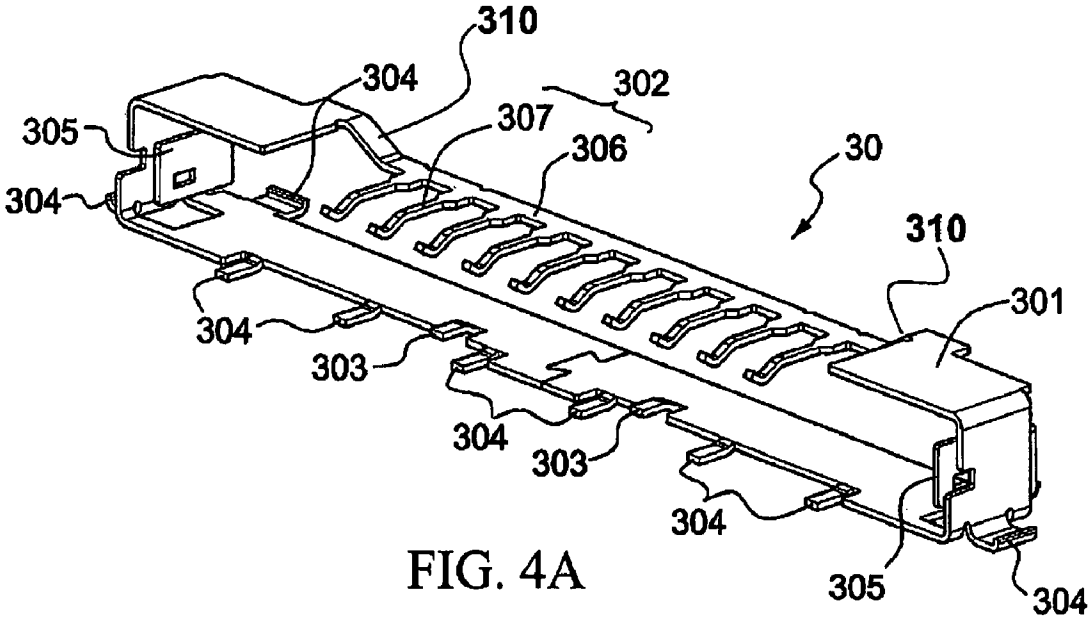
FIG. 4A is a perspective view of the metal shell of a connector shown in FIG. 1.
Figure 4B:
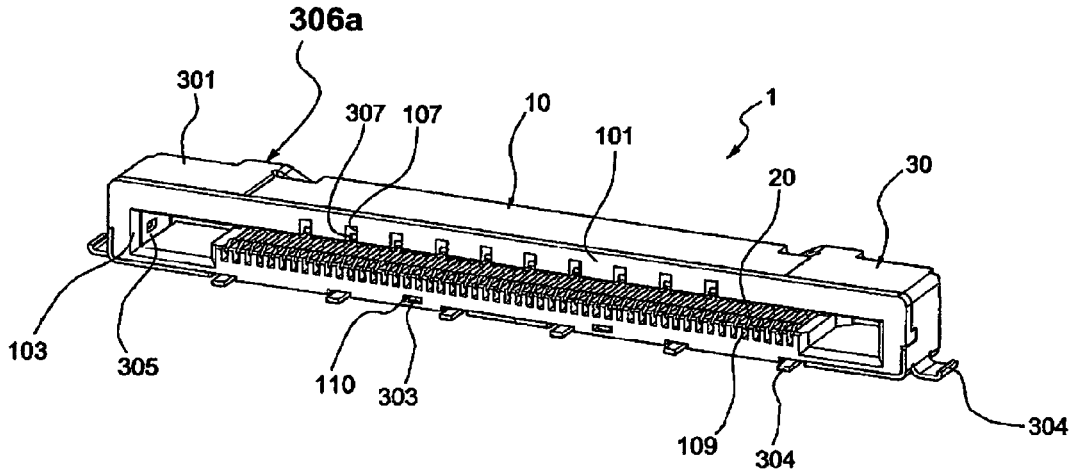
FIG. 4B is a perspective front view of a connector shown in FIG. 1 when assembled together.
Figure 4C:
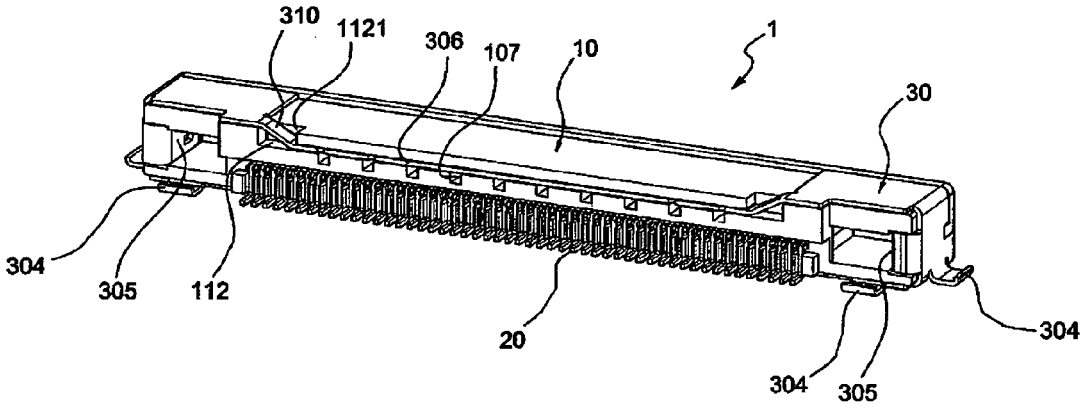
FIG. 4C is a perspective rear view of FIG. 4B.

Referring to FIG. 4A, metal shell 30 comprises a frame portion 301 and an inwardly deformed portion 302 which integrally connects to frame portion 301 via link or bent portions 310. Frame portion 301 has a plurality of first protruding tabs 303 and a plurality of second protruding tabs 304. Folding portions 305 extending from frame portion 301 and folded inwardly toward frame portion 301 are disposed on both lateral sides of frame portion 301. Inwardly deformed portion 302 of metal shell 30 is recessed downwardly with respect to frame portion 301. Inwardly deformed portion 302 comprises a straight portion 306. When metal shell 30 and housing 10 are assembled together, as shown in FIGS. 4B and 4C, a first edge 306*a* of straight portion 306 is positioned adjacent to rear surface 111 of housing 10. A second edge 306*b* of straight portion 306 is positioned away from rear surface 111. A plurality of grounding contacts 307 are formed integral and extended laterally from second edge 306*b* straight portion 306, by a one-step stamping or blanking process.

Figure 5:
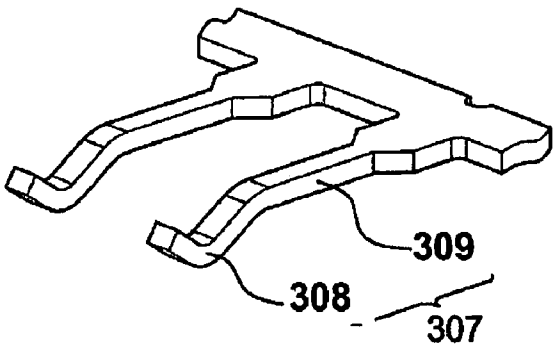
FIG. 5 is a partial enlarged view of FIG. 4A.

As shown in FIG. 5, each of grounding contacts 307 comprises a contact portion 308 and a spring portion 309. Contact portion 308 can be elastically moved up and down with respect to straight portion 307 via spring portion 309. Grounding contacts 307 are directly supported by straight portion 306 and thus have a high rigidity and strength compared to conventional connectors. Accordingly, grounding contacts 307 have a better durability and deformation resistance. Moreover, metal shell 30 and grounding contacts 307 can be fabricated by one stamping process. This also ensures the coplanarity of grounding contacts 307.

Figure 6:
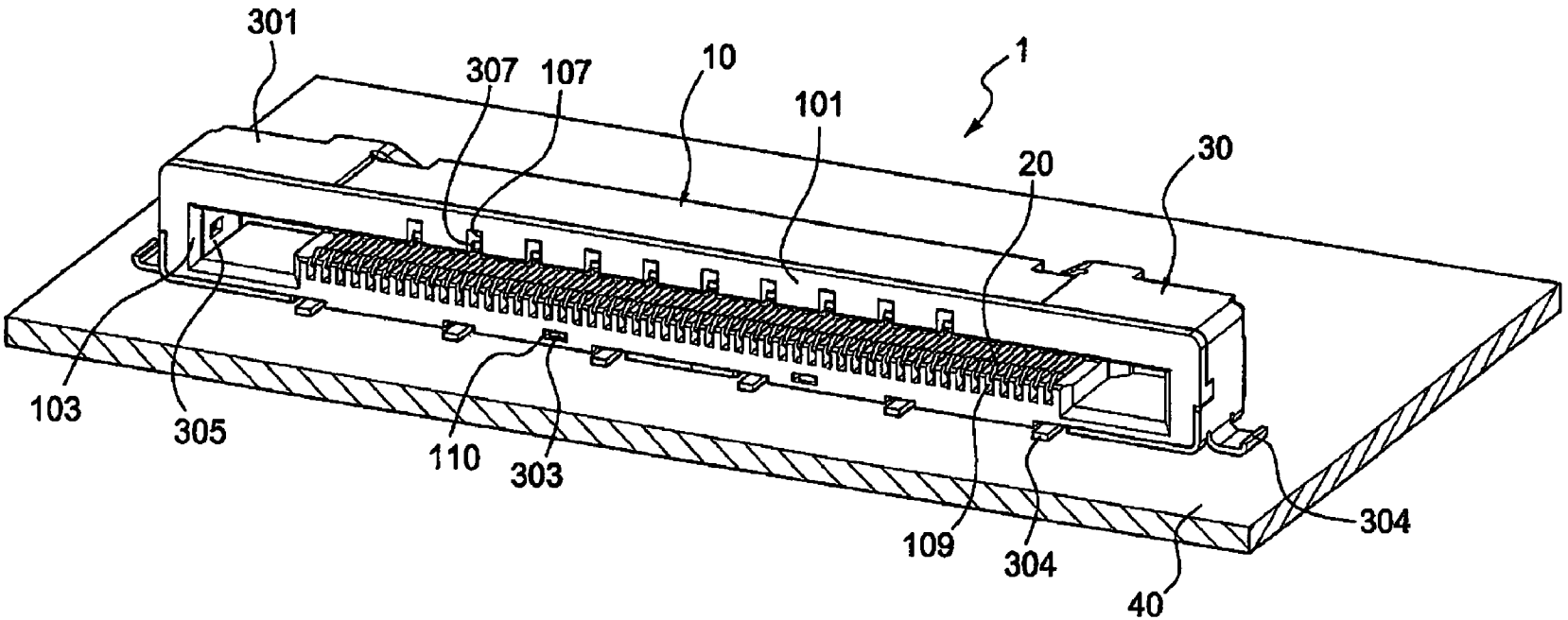
FIG. 6 is a perspective view of an electric connector of FIG. 1 when mounted to a circuit board.
Figure 7:
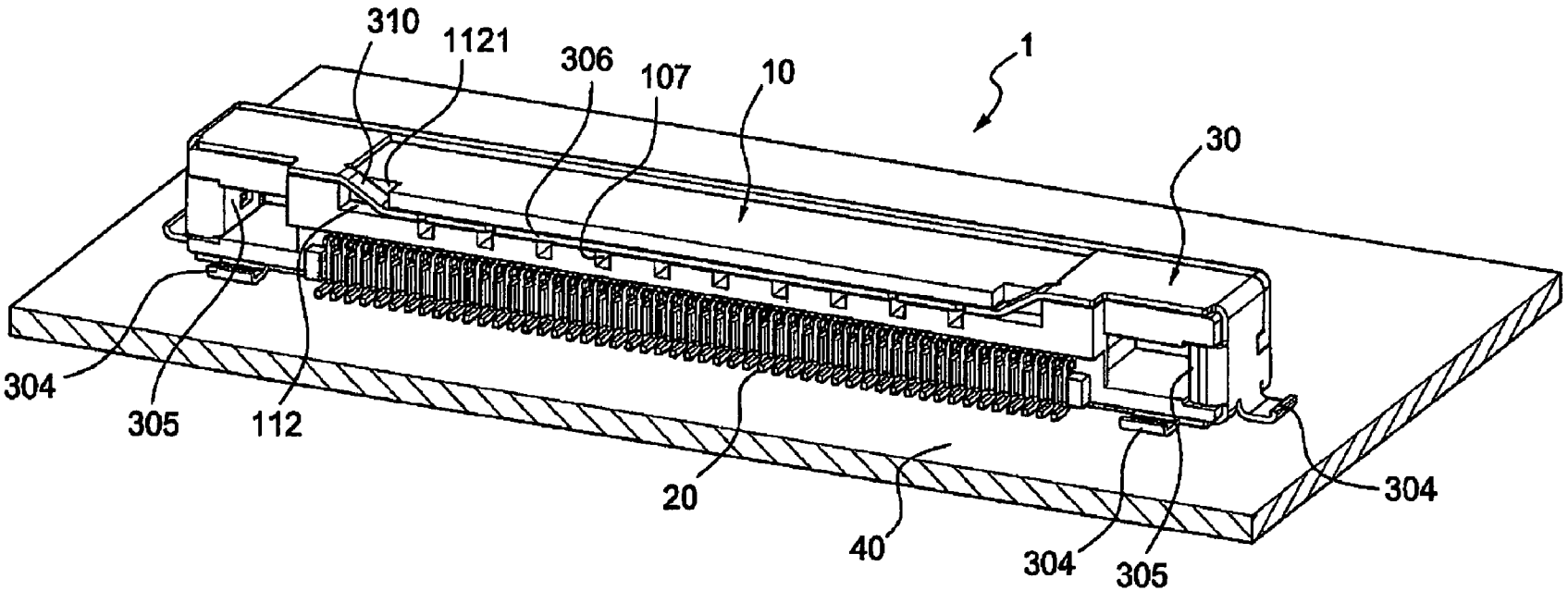
FIG. 7 is a perspective rear view of FIG. 6.

FIGS. 6 and 7 show the front side and the rear side of an electric connector, respectively. The assembling process of the electric connector of the present invention firstly comprises sheathing metal shell 30 onto housing 10 by aligning grounding contacts 307 from the rear side of housing 10 to the plurality of upper grooves 107, such that frame portion 301 encompasses housing 10. Meanwhile, grounding contacts 307 are inserted into the plurality of the upper grooves 107. Straight portion 306 of inwardly deformed portion 302 of metal shell 30 is just embedded into elongated recess 112 at the rear side of housing 10. Bent or link portion 310 of metal shell 30 is received in notch 1121 at both ends of recess 112. Folding portions 305 respectively engage with two side walls 103 of housing 10. First protruding tabs 303 of metal shell 30 are inserted into the plurality of holes 110 of housing 10 to form a press fit, and thus metal shell 30 is fixed to housing 10. Signal contacts 20 are then inserted into lower grooves 109 of housing 10, such that signal contacts 20 face grounding contacts 307 in the vertical direction, The assembly of the whole electric connector 1 is completed.

Electric connector 1 assembled in the above manner maybe fixed on, for example, a circuit board 40 via the plurality of second protruding tabs 304.

Figure 8:
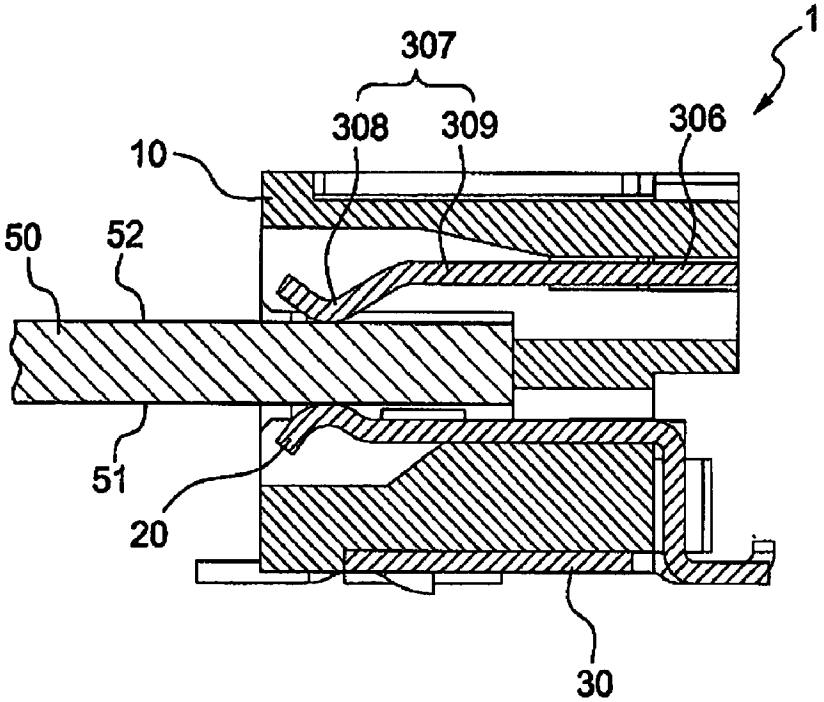
FIG. 8 is a partial cross-sectional view of an electric connector of FIG. 1 when connected to a counterpart connector.

As shown in FIG. 8, a counterpart connector 50 is inserted into space 105 of electric connector 1. A first set of conductive terminals or surfaces 51 of counterpart connector 50 respectively contact each of the signal contacts 20 to establish signal connection. A second set of conductive terminals or surfaces 52 of counterpart connector 50 respectively contact the contact portion 308 of each of the grounding contacts 307, to establish grounding contacts. Contact portion 308 can be elastically deformed up and down by spring portion 309, with respect to straight portion 306, and thus grounding contacts 307 are elastically deformed to force contact portion 308 urging against second set of conductive terminals or metal surfaces 52.

Figure 9:
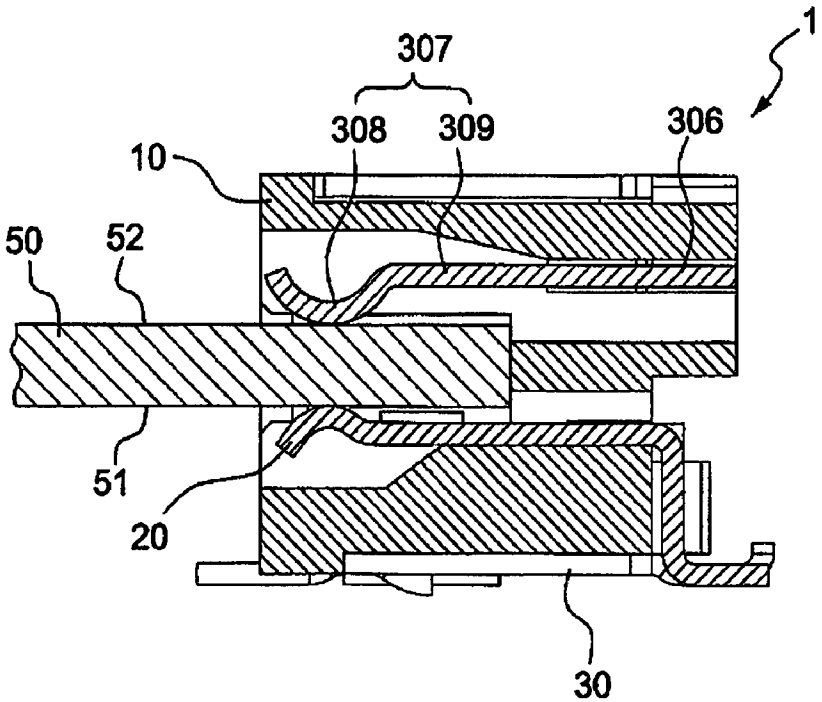
FIG. 9 is a partial cross-sectional view of an electric connector according to another embodiment of the present invention and when connected to a counterpart connector.

Contact portion 308 may be V-shaped or semicircular in cross section, as shown in FIG. 9, and to urge against the second metal surface 52 by the bottom side thereof. Signal contacts 20 may also have a similar construction to be urged against first set of metal surfaces 51. Signal contacts 20 and grounding contacts 307 can now clamp counterpart connector 50, thus achieving the complete signal connection and grounding connection.

Figure 10:
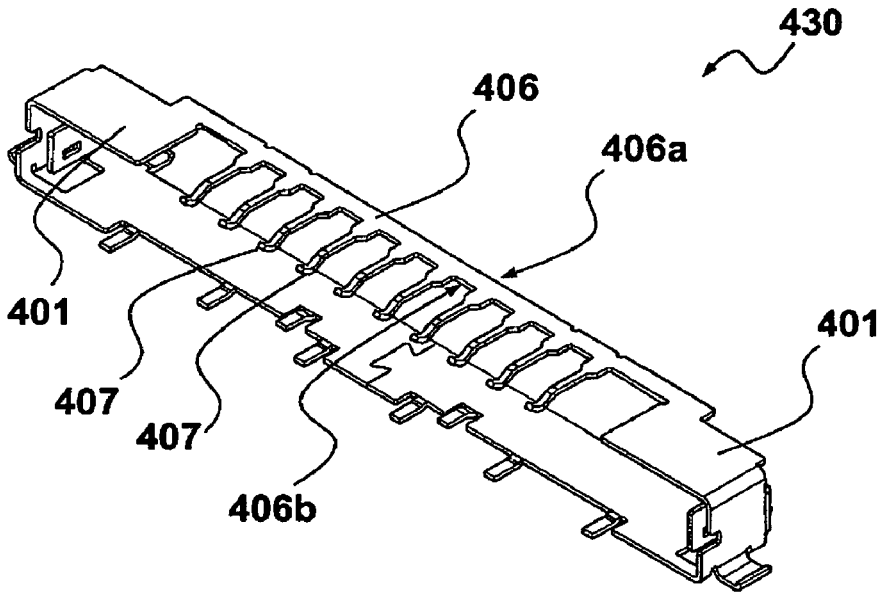
FIG. 10 is a perspective view showing a metal shell for an electric connector according to a further embodiment of the present invention.
Figure 11:
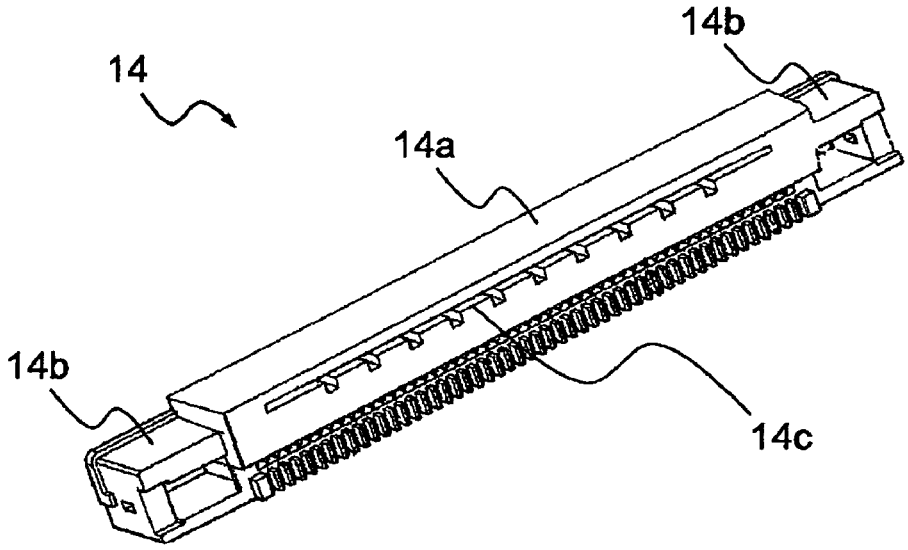
FIG. 11 is a perspective view showing a housing for assembling with the metal shell shown in FIG. 10.

In a further embodiment shown in FIGS. 10 and 11, straight portion 406 of a metal shell 430 is not depressed, but is maintained within a same plane as corner portions 401. Grounding contacts 407 are formed integral of, and extended laterally from, a second edge 406*b* of straight portion 406. A housing 14 according to this embodiment has a raised center portion at upper surface, with respect to corner portions 14*b*. When metal shell 430 and housing 14 are assembled together, straight portion 406 of metal shell 430 is received in a recess 14*c* formed below center portion 14*c*. In addition, corner portions 401 of metal shell 430 cover corner portions 14*b* of housing 14.

Advantages of the present invention include, for example, in the structure of the metal shell of the electric connector of the present invention, the straight portion and grounding contacts of the inwardly deformed portion are formed simultaneously through a one-step stamping process. Moreover, since the grounding contacts of the present invention may be accomplished by only one process the grounding contacts still remain a preferred coplanarity and a high yield, such that the grounding contact between the electric connector and the plug connector is good and avoids inefficacy. Another advantage is that, the structure of the metal shell of the electric connector of the present invention has a simple manufacturing process and a high yield, thereby effectively improving the manufacturing efficiency and reducing the manufacturing cost to improve the competition ability.

Though the present invention has been disclosed above by the preferred embodiments, they are not intended to limit the present invention. Persons skilled in the art can make modifications and variations without departing from the spirit and scope of the present invention. Therefore, the protecting range of the present invention falls in the appended claims and their equivalents.

The invention claimed is:

1. An electric connector, comprising:

a housing having a front surface and a back surface;

a plurality of signal contacts disposed in the housing;

a metal shell covering side surfaces of the housing, one segment of the metal shell having a first edge positioned adjacent to the back surface and a second edge positioned adjacent to the front surface; and a plurality of ground contacts disposed in the housing;

wherein the plurality of ground contacts are formed integral of and extended forwardly from the second edge of said segment, wherein said segment is supported by two corner portions of the metal shell, wherein said segment is depressed with respect to the two corner portions, wherein the housing has a recess formed at a back surface thereof for receiving said segment of the metal shell, wherein said segment is connected to the two corner portions via a respective link portion, wherein the housing further comprising a notch formed at each end portion of the recess for receiving one of the link portion.

2. The electric connector of claim 1, wherein said segment is supported by two corner portions of the metal shell, wherein said segment is within a same plane as the two corner portions.

3. The electric connector as claimed in claim 1, wherein the signal contacts and the grounding contacts are to clamp the counterpart connector.

4. An electric connector, comprising:

a housing, comprising:

a body, comprising a first wall, a second wall opposite to the first wall, and a space formed between the first wall and the second wall for receiving a counterpart connector;

a plurality of upper grooves, formed on a first inner surface of the first wall;

a plurality of lower grooves, formed on a second inner surface of the second wall; and a recess, formed on an outer rear surface of the housing, wherein the recess is communicating with the space through the upper grooves, and two ends of the recess are respectively formed with a notch penetrating upwardly;

a plurality of signal contacts, disposed in the lower grooves of the housing; and a metal shell, comprising:

a frame portion, encompassing the housing;

an inwardly deformed portion, integrally connecting the frame portion by means of a bent portion bending downwardly and recessed downwardly with respect to the frame portion, the inwardly deformed portion comprising:

a straight portion embedded in the recess of the housing; and a plurality of grounding contacts extending from the straight portion and inserting into the upper grooves.

5. The electric connector as claimed in claim 4, wherein each of the grounding contacts comprises:

a contact portion, for contacting the counterpart connector to achieve grounding; and a spring portion, coupled to the contact portion for urging the contact portion against the counterpart connector.

6. The electric connector as claimed in claim 5, wherein the contact portion is V-shaped.

7. The electric connector as claimed in claim 5, wherein the contact portion is semicircular.

8. The electric connector as claimed in claim 4, wherein the metal shell further comprises at least one folding portion extending from the frame portion and folded inwardly into the frame portion to engage to at least one side wall of the housing.

9. The electric connector as claimed in claim 4, wherein the housing further comprises a plurality of holes and the metal shell further comprising a plurality of tabs each for being received in a hole to fix the metal shell and the housing together.

10. The electric connector as claimed in claim 4, wherein the metal shell further comprises a plurality of second protruding tabs for fixing the connector onto a circuit board.

* * * * *